US008602019B2

(12) United States Patent
Baker et al.

(10) Patent No.: US 8,602,019 B2
(45) Date of Patent: Dec. 10, 2013

(54) RETRACTABLE OVEN RACK ASSEMBLY

(75) Inventors: Edward Baker, Waverly, TN (US); George May, New Bern, NC (US); Howard Saunders, Goodlettsville, TN (US); Manfred Staebler, New Bern, NC (US); Daron Whitehead, Murfreesboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 1120 days.

(21) Appl. No.: 12/560,490

(22) Filed: Sep. 16, 2009

(65) Prior Publication Data

US 2010/0000514 A1 Jan. 7, 2010

Related U.S. Application Data

(63) Continuation of application No. 10/987,634, filed on Nov. 12, 2004, now abandoned.

(51) Int. Cl.
*F24C 15/16* (2006.01)

(52) U.S. Cl.
USPC ..... 126/339; 126/332; 126/337 R

(58) Field of Classification Search
USPC ..... 126/332, 337 A, 337 R, 339
See application file for complete search history.

(56) References Cited

U.S. PATENT DOCUMENTS 1,872,733 A * 8/1932 Greenwald ..... 126/337 R
1,896,307 A 2/1933 Hatch
1,974,983 A * 9/1934 Cook ..... 108/137
1,995,399 A * 3/1935 Reedy et al. ..... 126/339
2,008,091 A 7/1935 Betts
2,015,389 A * 9/1935 Whitted ..... 108/143
2,033,792 A * 3/1936 Sywert et al. ..... 211/153
2,033,859 A 3/1936 Otte
2,065,391 A * 12/1936 Nance ..... 312/308
2,078,681 A * 4/1937 Otte ..... 312/246
2,098,198 A * 11/1937 Sindelar ..... 108/143
2,168,172 A * 8/1939 Rees ..... 108/62
2,225,991 A 12/1940 Hobson
2,376,640 A * 5/1945 Wall et al. ..... 99/426
2,466,360 A 4/1949 Bitney
2,760,649 A * 8/1956 Rataiczak ..... 211/162
3,403,789 A * 10/1968 La Morte et al. ..... 211/150
3,717,259 A * 2/1973 Fried et al. ..... 211/126.9
3,977,389 A * 8/1976 Ondrasik, II ..... 126/337 R
4,194,495 A * 3/1980 Scherer ..... 126/339

(Continued)

FOREIGN PATENT DOCUMENTS

EP 0091666 A2 10/1983

*Primary Examiner* — Kenneth Rinehart
*Assistant Examiner* — Jorge Pereiro
(74) *Attorney, Agent, or Firm* — James E. Howard; Andre Pallapies

(57) ABSTRACT

A retractable oven rack includes a slidable wire base with four wire sections extending generally horizontally around a periphery. Two of the wire sections extend parallel to each other along the width of the wire base and the other two extend parallel along the length. The four wires sections are connected to each other at their ends. A pair of support rods extend from and respectively parallel two of the wire sections along the length of the slidable wire base. The oven rack also includes a grid shelf having a pair of raised wire sections extending the length of the grid shelf that are slidably supported on the pair of support rods for allowing the grid shelf to be supported and slide on the pair of support rods.

21 Claims, 7 Drawing Sheets

(56) References Cited

U.S. PATENT DOCUMENTS

| | | | | |
|---|---|---|---|---|
| 5,558,237 | A * | 9/1996 | Ancona | 211/133.2 |
| 6,148,813 | A * | 11/2000 | Barnes et al. | 126/339 |
| 6,279,467 | B1 | 8/2001 | Tiemann | |
| 6,341,704 | B1 * | 1/2002 | Michel, Jr. | 211/181.1 |
| 6,729,484 | B2 * | 5/2004 | Sparkowski | 211/187 |
| D509,405 | S * | 9/2005 | Shin | D7/409 |
| 6,976,597 | B2 * | 12/2005 | Jahrling et al. | 211/175 |
| 7,347,198 | B2 * | 3/2008 | Freese et al. | 126/337 R |
| 2003/0192847 | A1 * | 10/2003 | Jahrling et al. | 211/175 |
| 2004/0035813 | A1 * | 2/2004 | Sparkowski | 211/187 |
| 2005/0204933 | A1 * | 9/2005 | Freese et al. | 99/450 |
| 2006/0102015 | A1 * | 5/2006 | Baker et al. | 99/450 |
| 2006/0185661 | A1 * | 8/2006 | Metcalf et al. | 126/339 |

* cited by examiner

RETRACTABLE OVEN RACK ASSEMBLY

CROSS-REFERENCE TO RELATED APPLICATION

This application is a continuation, under 35 U.S.C. §120, of U.S. application Ser. No. 10/987,634, filed Nov. 12, 2004, and incorporates by reference the entire prior application.

BACKGROUND OF THE INVENTION

1. Field of the Invention

This invention relates to a retractable oven rack assembly for use in an oven. The invention also relates to a combination oven and retractable oven rack. More particularly, the invention relates to a retractable oven rack assembly made up of two parts, with a grid shelf supported on a slidable base which can be slid out of the oven, and the grid shelf is slidable on top of the base for being easily extended out of and retracted back into the oven cavity.

2. Discussion of the Prior Art

In cooking appliances such as ovens or free standing ranges which include ovens, the oven cavity is typically populated with one or more racks to support food items being cooked in the oven. The oven cavities include support slots, racks or ledges in the side walls thereof which allow the oven racks to be slidably received and retained within the oven cavity. The support slots, racks or ledges also typically include an upward or downward projection near the front of the oven cavity which serves as a stop which abuts against a corresponding projection in one or both of the front and in the back of an oven rack. The stop prevents the oven rack from being inadvertently pulled completely out of the oven when supporting food thereon, and to prevent the oven rack from being pushed too far back into the oven to avoid contact between the rear of the oven rack and the interior back wall of the oven cavity. The oven rack is easily removed from the support slots, racks or ledges for moving to another height in the oven or for removable for cleaning.

In these types of arrangements, due to the fact that the oven rack must be supported over a substantial portion thereof by the support slots or ledges of the oven cavity walls, the amount which the rack can be extended out of the oven cavity is limited. This results in difficulty in positioning food items on such racks or in removing the food items from the rack. This also creates a danger that the person removing or replacing such items on the rack may inadvertently contact the hot walls of the oven cavity.

More recently, in order to avoid these problems, there have been designed extendable rack arrangements for use in an oven cavity, which allow an oven rack to be extended well out of an oven cavity. One design involves a rack assembly, which includes a rack extendable upon a primary rack frame, which is itself mounted for sliding movement relative to the oven cavity. The rack is supported upon guides carried by the rack frame with multiple sets of rollers. While desirable from the perspective of allowing greater extension of the oven rack out of the cavity of the oven, this type of arrangement takes up a substantial amount of additional space within an oven cavity due to the fact that it is essentially a double rack arrangement, with each rack separated from each other by a space consuming roller mechanism which can easily break. As such, while desirable from the perspective of allowing the rack to be extended outside of the oven cavity, this type of rack arrangement substantially decreases the useable volume in an oven cavity, particularly when multiple rack assemblies of this type are used. Further, the complexity of the extendable rack assembly adds cost to the oven and may also cause failures due to the many moving parts of the extendable rack assembly.

In a more recent arrangement, a full extension slide is provided on a rack frame resting on the supports, such as slots, racks or ledges of the oven, with a rack coupled to the full extension slide. In this arrangement, the rack frame rests on supports of the oven with the upper portion of the rack frame holding the extension slides at essentially the same level as the rack coupled to the full extension slide.

While providing a more simplified arrangement than the afore-described double rack assembly, this design still suffers from the requirement of having a compound rack system wherein two racks are required, one being a wire frame rack and the other being the actual rack that holds the food being cooked in the oven.

BRIEF SUMMARY OF THE INVENTION

In accordance with an exemplary embodiment of the invention, the problems of the extendable open racks in current use are avoided, and an oven rack assembly is provided which allows full extension of an oven rack outside of an oven cavity, is simple in construction, and ensures that the oven rack is securely held by the supports of the oven cavity.

An exemplary embodiment of a retractable oven rack in accordance with the invention includes a slidable wire base of generally rectangular shape with four wire sections extending generally horizontally around the periphery thereof. A first two of the wire sections extend parallel to each other along the width of the wire base and a second two extend parallel to each other along the length thereof. By "width" it is meant the portion which extends along the front entrance of the oven cavity. By "length" is the portion that extends inwardly through the depth of the oven cavity. The wire sections are connected to each other at the ends thereof and are preferably a single continuous piece. A pair of support rods are located raised from and extend respectively parallel to the second two wire sections in proximity thereto. The support rods are connected at each end to a respective one of the first two wire sections. A grid shelf has a pair of raised wire sections extending the length of the grid shelf at a location for being slidably supported on the pair of support wire sections, for allowing the grid shelf to slide on the pair of support rods.

In another exemplary embodiment, one of the first two wire sections includes a raised section at the rear of the wire base to form respective first stops at the connections between the wire section of the first two wire sections at the rear, and the second two wire sections. The other end of the first two wire sections includes a raised section at the front of the of the wire base to form a second set of stops. In a yet still further aspect, the base includes a projection on each of the support wire sections to form a wire grid shelf stop for limiting sliding movement of the grid shelf relative to the wire base to a predetermined amount forward to prevent the grid shelf from inadvertently falling out of the oven when it is extended outward from its retracted position.

Another exemplary embodiment includes the aforementioned retractable oven rack in combination with an oven having the above-described retractable oven racks.

BRIEF DESCRIPTION OF THE SEVERAL VIEWS OF THE DRAWING

Having briefly described the present invention, the same will become better understood from the following detailed description, made with reference to the appended drawing, wherein.

DETAILED DESCRIPTION OF THE INVENTION

Figure 1:
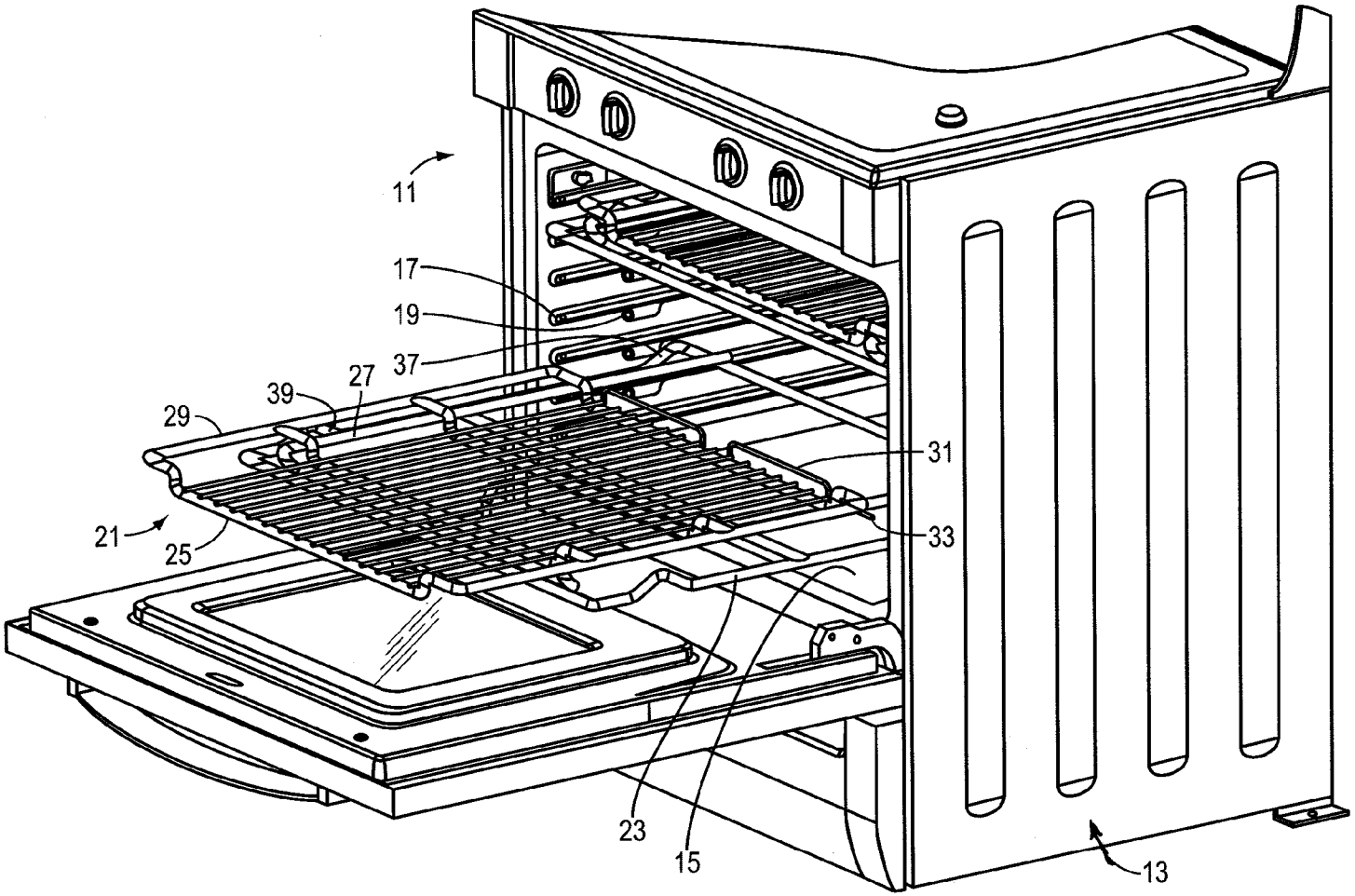
FIG. 1 is a perspective view showing an oven and the retractable oven racks of the present invention shown received within an oven cavity.

FIG. 1 is a perspective view of the oven rack system 11 in accordance with the present invention. An oven 13 includes an oven cavity 15 and oven rack support, here a plurality of shelves 17, with the respective parallel opposite shelves not shown. The shelves 17 each include a shelf stop 19, which serves to limit the movement of an oven rack outwardly from the cavity 15 and into the oven cavity 15.

A retractable oven rack 21 in accordance with the present invention includes two separate parts, a slidable wire base 23 and a grid shelf 25.

Figure 2:
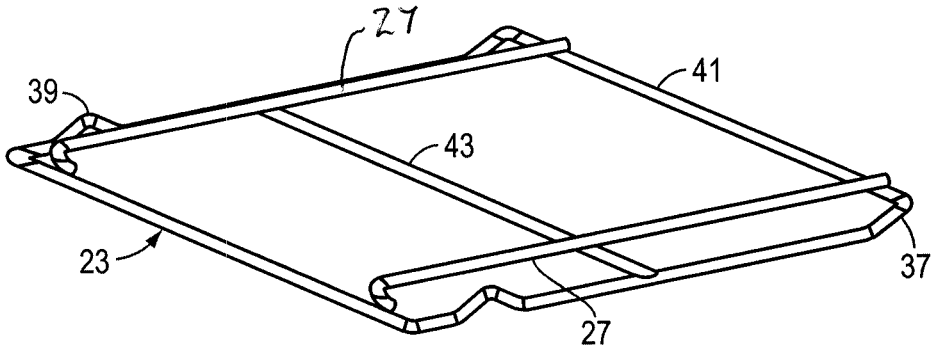
FIG. 2 is a perspective view of the wire base of the retractable oven rack.

As shown in FIG. 2, the wire base 23 is made of four generally horizontally extending wire sections, two along the width and two along the length thereof. The wire base includes a pair of support rods 27 connected thereto and a strengthening rod 43 extending across the middle of the wire base 23 along the width thereof. A wire rod 41 is positioned at the rear, and makes up one of the two wire sections extending along the length of the wire base 23. The wire rod 41 is preferably raised to create a bent portion 37 at the rear of the wire base which serves as a stop when the wire base 23 is extended out of the oven cavity 15 by abutting against the shelf stop 19. Both of the support rods 27 serve to support the grid shelf 25 in sliding relationship thereto.

Figure 3:
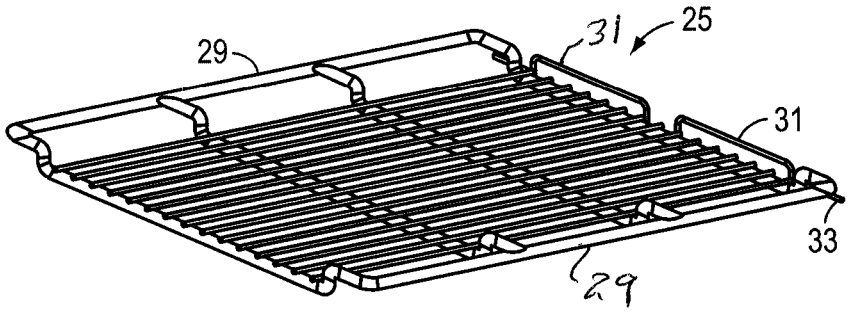
FIG. 3 is a perspective view of the grid shelf of the retractable oven rack.

As shown in FIG. 3, the grid shelf 25 includes a pair of raised wire sections 29 which rest on the raised supports 27 in sliding relationship thereto. The rear of the grid shelf 25 also includes a pair of wire elements 31 attached to create a wall at the rear of the grid shelf 25 to prevent articles from "sliding off" the rear of the grid shelf 25.

As also shown in FIGS. 1 and 3, the grid shelf 25 includes a grid stop member 33 as an extension of the rear of the grid shelf 25 which extends below the raised support rods 27 to abut against a wire base grid shelf stop (discussed hereafter) to limit movement of the grid shelf 25 when extended out from the oven cavity 15.

Figure 4:
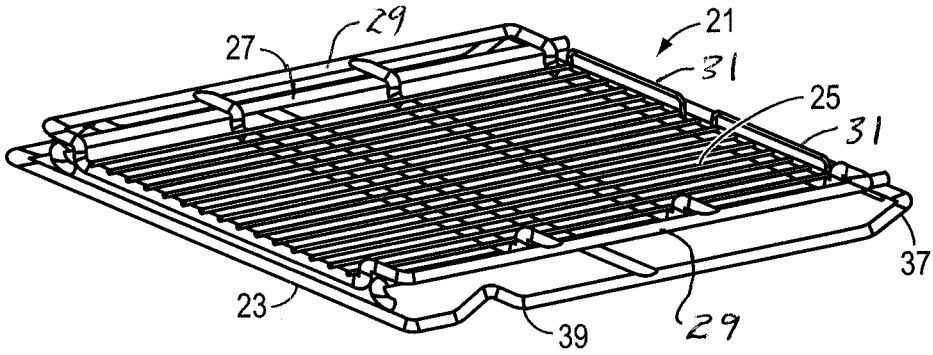
FIG. 4 is a perspective view of the oven rack assembly of the present invention shown with the grid shelf assembled on the wire base.

FIG. 4 illustrates the retractable oven rack 21 in assembled form with the wire base 23 having the grid shelf 25 supported thereon. The bent portion stop 37, which abuts against shelf stop 19 is more clearly shown in this view. In addition, the wire base 23 also includes a bent portion 39 near the front thereof which serves as a second stop when the retractable oven rack 21 is fully received within the oven cavity, to abut against the shelf stop 19 to prevent further movement of the retractable oven rack into the oven cavity 15 and thus, prevent it from hitting the back wall of the oven cavity 15.

Figure 5:
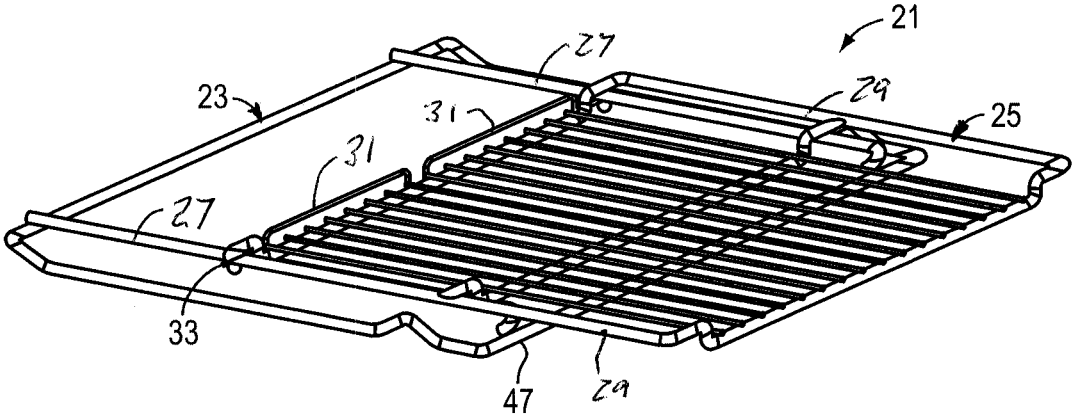
FIG. 5 is a view as in FIG. 4 but showing the grid shelf slidably extended over and from the wire base.

FIG. 5 shows an alternative embodiment of the retractable oven rack of the invention in which the front of the wire base 23 has a portion 47 at the front thereof which is bent downward to provide spacing to allow a user to directly hold on to the wire base 23 without contact with the grid shelf 25. FIG. 5 also more clearly illustrates the grid shelf stop member 33 with the grid shelf 25 in extended condition relative to the wire base 23.

Figure 6:
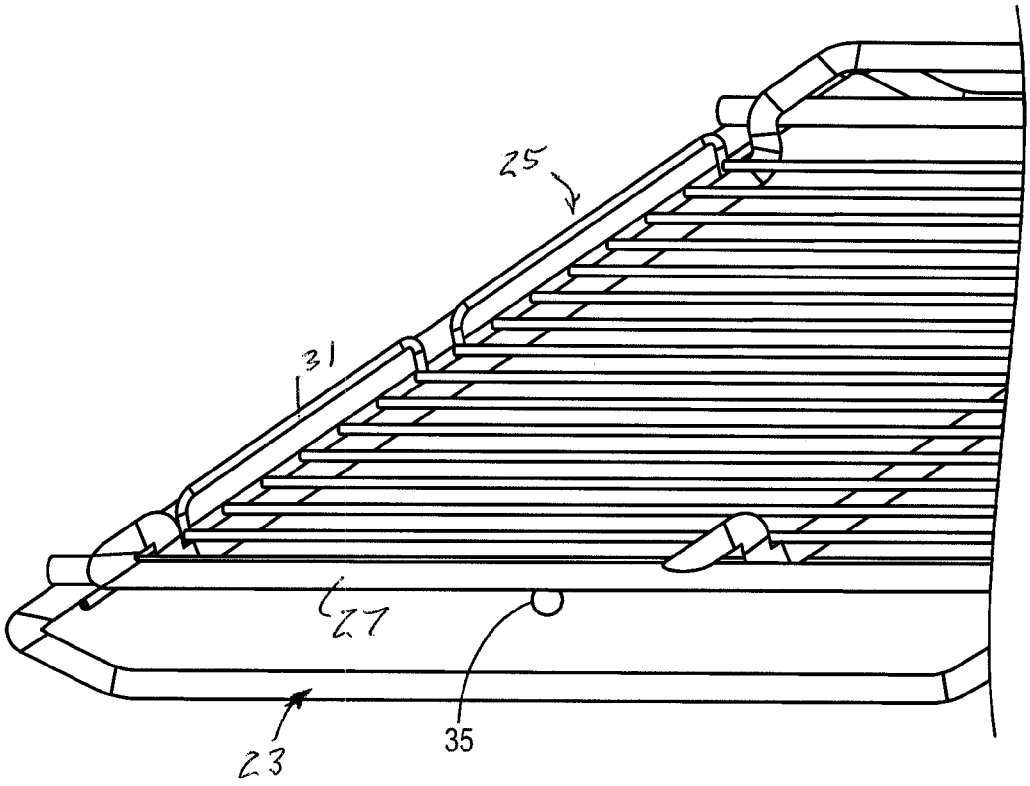
FIG. 6 is a partial side view showing a stop for limiting movement of the grid shelf when it is extended outwardly from an oven by sliding on the wire base.
Figure 7:
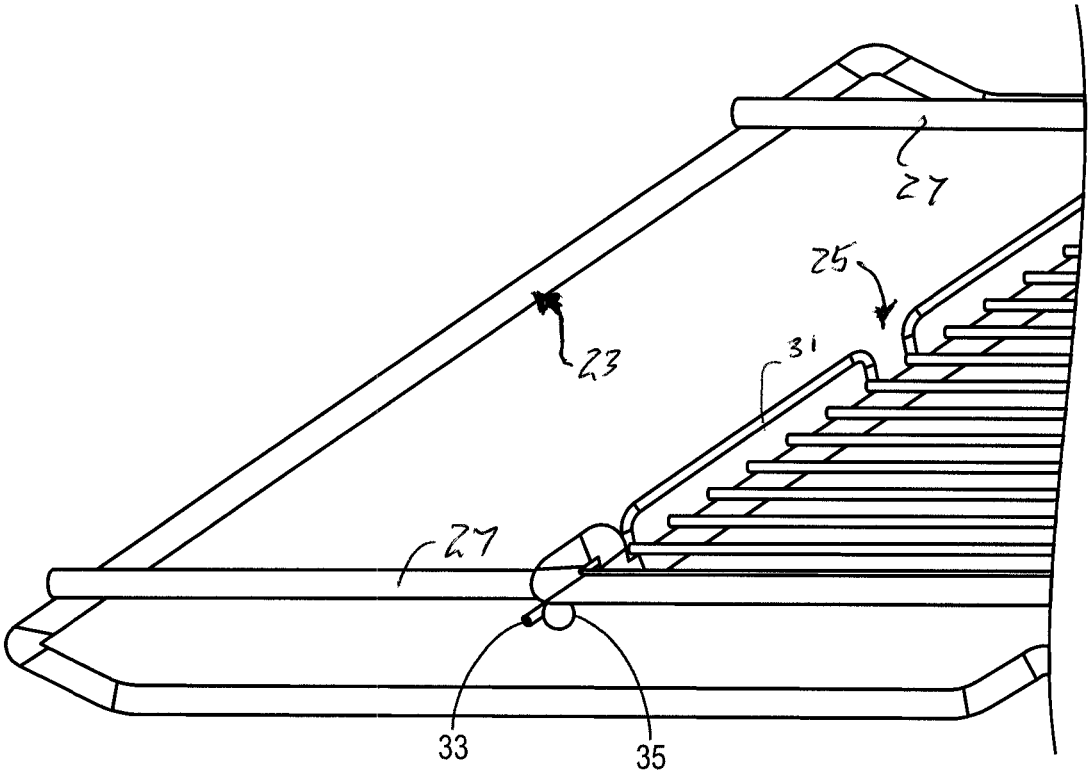
FIG. 7 is a view as in FIG. 6 but showing the grid shelf extended and stopped by the stop of the wire base.

FIGS. 6 and 7 further illustrate the relationship between the grid shelf stop 33 and a wire base grid shelf stop 35. In this case, the wire based grid shelf stop 35 is made up of a bead attached to the support rods 27 on the underside thereof. FIG. 7, in particular illustrates the grid shelf 35 in a partial view in fully extended condition with the grid shelf stop 33 in abutment with the wire base grid shelf stop 37.

Figure 8:
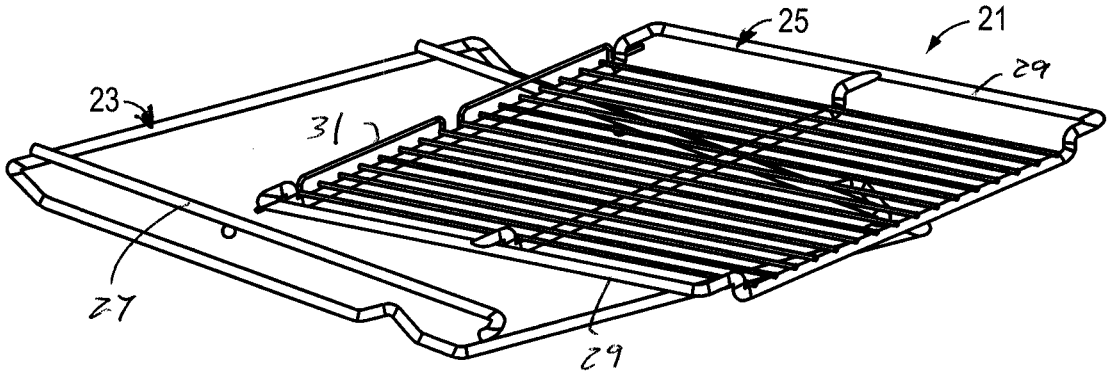
FIG. 8 is a perspective view of the retractable oven rack illustrating how the grid shelf can be disassembled from the wire base by turning them relative to one another.

FIG. 8 illustrates how the separate wire base 23 and the grid shelf 25 of the retractable oven rack 21 can be disassembled. This is done by a twisting operation whereby the grid shelf stop 33 becomes disengaged from beneath the raised support 27 at one end thereof to allow disassembly of the retractable oven rack 21, for example, for cleaning purposes.

With respect to the materials employed, a variety of conventional metals or alloys can be used in manufacturing the retractable oven rack 21. Examples of such materials are nickel-plated carbon steel wire or nickel chrome cold rolled rod. More particularly, the materials should be capable of withstanding typical oven temperatures over long periods of time as will become readily apparent to those of ordinary skill in the art.

Having thus generally described the invention, the same will become better understood from the appended claims in which it is set forth in a non-limiting manner.

What is claimed is:

1. A retractable oven rack, comprising:

a wire base that is slidably mountable on protruding shelf members located on two opposite inner walls of an oven cavity, the wire base including first and second wire sections that are parallel to one another and that extend across the front and rear of the wire base and third and fourth wire sections that are parallel to one another and that extend along opposite sides of the wire base, wherein upwardly angled portions are formed adjacent ends of the third and fourth wire sections, the upwardly angled portions being configured to engage stops on the protruding shelf members on the inner walls of an oven cavity to limit the amount that the wire base can be slid out of and into the oven cavity, the wire base further comprising first and second wire support rods that extend parallel to and above the third and fourth wire sections on opposite sides of the wire base; and a grid shelf comprising a wire grid and first and second supports that extend parallel to opposite side edges of the wire grid and above the wire grid, wherein the first and second supports rest on and are slidably supported by the first and second wire support rods such that the grid shelf can be slid forwards and backwards along the wire base, wherein the wire grid is disposed between the first wire section and the first and second wire support rods when viewed from a side of the retractable oven rack.

2. The retractable oven rack of claim 1, wherein the grid shelf comprises:

a plurality of upper wires that extend parallel to one another and to the side edges of the grid shelf, the upper wires forming a support surface; and a plurality of lower wires that extend parallel to the front and rear edges of the grid shelf and that are attached to and support the plurality of upper wires.

3. The retractable oven rack of claim 2, wherein the first and second supports comprise upwardly bent end portions of the plurality of lower wires.

4. The retractable oven rack of claim 3, wherein the first and second supports further comprise first and second wire edges that extend along opposite side edges of the grid shelf and that are attached to respective end portions of the lower wires.

5. The retractable oven rack of claim 1, wherein the grid shelf further comprises first and second grid stops that project from opposite sides of the rear of the grid shelf.

6. The retractable oven rack of claim 1, wherein opposite ends of the first and second wire support rods of the wire base are coupled to the first and second wire sections that extend across the front and rear of the wire base.

7. The retractable oven rack of claim 6, wherein the wire base further comprises a strengthening rod that extends between the third and fourth wire sections.

8. The retractable oven rack of claim 1, wherein the grid shelf further comprises at least one wire element having its ends attached to a rearmost one of the lower wires and having a middle portion that extends upward above the upper wires to prevent items from being pushed backwards off the support surface formed by the plurality of upper wires.

9. An oven comprising the retractable oven rack of claim 1.

10. The oven of claim 9, wherein protruding shelf members are located on two opposite inner walls of a cooking cavity of the oven, the shelf members being arranged in pairs on the opposite inner walls at a plurality of levels within the cooking cavity, and wherein the retractable oven rack is mountable on each pair of the shelf members.

11. The oven of claim 10, wherein stops are formed on each of the protruding shelf members.

12. A retractable oven rack, comprising:

a wire base that is slidably mountable on protruding shelf members located on two opposite inner walls of an oven cavity, the wire base including first and second wire sections that are parallel to one another and that extend across the front and rear of the wire base and third and fourth wire sections that are parallel to one another and that extend along opposite sides of the wire base, wherein upwardly angled portions are formed adjacent ends of the third and fourth wire sections, the upwardly angled portions being configured to engage stops on the protruding shelf members on the inner walls of an oven cavity to limit the amount that the wire base can be slid out of and into the oven cavity, the wire base further comprising first and second wire support rods that extend parallel to and above the third and fourth wire sections on opposite sides of the wire base; and a grid shelf comprising a wire grid and first and second supports that extend parallel to opposite side edges of the wire grid and above the wire grid, wherein the first and second supports rest on and are slidably supported by the first and second wire support rods such that the grid shelf can be slid forwards and backwards along the wire base; and a lower wire located at a rear of the grid shelf and under at least one of the first and second wire support rods, the lower wire being adapted to prevent upward movement of a rear portion of the grid shelf with respect to the first and second wire support rods.

13. A retractable oven rack, comprising:

a wire base that is slidably mountable on protruding shelf members located on two opposite inner walls of an oven cavity, the wire base including first and second wire sections that are parallel to one another and that extend across the front and rear of the wire base and third and fourth wire sections that are parallel to one another and that extend along opposite sides of the wire base, wherein upwardly angled portions are formed adjacent ends of the third and fourth wire sections, the upwardly angled portions being configured to engage stops on the protruding shelf members on the inner walls of an oven cavity to limit the amount that the wire base can be slid out of and into the oven cavity, the wire base further comprising first and second wire support rods that extend parallel to and above the third and fourth wire sections on opposite sides of the wire base; and a grid shelf comprising:

a wire grid, a plurality of upper wires that extend parallel to one another and to the side edges of the grid shelf, the upper wires forming a support surface, a plurality of lower wires that extend parallel to the front and rear edges of the grid shelf and that are attached to and support the plurality of upper wires, and first and second supports that extend parallel to opposite side edges of the wire grid and above the wire grid, wherein the first and second supports rest on and are slidably supported by the first and second wire support rods such that the grid shelf can be slid forwards and backwards along the wire base, wherein a lower wire located at a rear of the grid shelf contacts the second wire section of the wire base when the grid shelf is slid backwards on the wire base to limit the amount that the grid shelf can be slid backwards on the wire base.

14. A retractable oven rack, comprising:

a wire base that is slidably mountable on protruding shelf members located on two opposite inner walls of an oven cavity, the wire base comprising:

first and second wire sections that are parallel to one another and that extend across the front and rear of the wire base;

third and fourth wire sections that are parallel to one another and that extend along opposite sides of the wire base; and first and second wire support rods that extend parallel to and above the third and fourth wire sections on opposite sides of the wire base, wherein a grid shelf stop member is formed on a lower portion of each of the first and second wire support rods; and a grid shelf comprising:

a wire grid that forms a support surface; and first and second supports that extend parallel to opposite side edges of the wire grid and that are located above the wire grid, wherein the first and second supports rest on and are slidably supported by the first and second wire support rods such that the grid shelf can be slid forwards and backwards along the wire base, wherein the grid shelf also includes first and second grid stops that project from opposite sides of the grid shelf at the rear of the grid shelf, and wherein the grid shelf stop members on the wire base block forward movement of the grid stops on the grid shelf to limit the amount that the grid shelf can be slid forward along the wire base.

15. The retractable oven rack of claim 14, wherein the grid shelf comprises:

a plurality of upper wires that extend parallel to one another and to side edges of the grid shelf, the upper wires forming a support surface; and a plurality of lower wires that extend parallel to front and rear edges of the grid shelf and that are attached to and support the plurality of upper wires.

16. The retractable oven rack of claim 15, wherein the first and second supports comprise upwardly bent end portions of the plurality of lower wires.

17. The retractable oven rack of claim 16, wherein the first and second supports further comprise first and second wire edges that extend along opposite side edges of the grid shelf and that are attached to respective end portions of the lower wires.

18. The retractable oven rack of claim 15, wherein a lower wire located at a rear of the grid shelf contacts the second wire section of the wire base when the grid shelf is slid backwards on the wire base to limit the amount that the grid shelf can be slid backwards on the wire base.

19. An oven comprising the retractable oven rack of claim 14, wherein protruding shelf members are located on two opposite inner walls of a cavity of the oven, the shelf members being arranged in pairs on the opposite inner walls at a plurality of levels within the cooking cavity, and wherein the retractable oven rack is mountable on each pair of the shelf members.

20. The oven of claim 19, wherein stops are formed on each of the protruding shelf members, and wherein upwardly angled portions are formed adjacent ends of the third and fourth wire sections of the wire base, the upwardly angled portions being configured to engage the stops on the protruding shelf members to limit the amount that the wire base can be slid out of and into the cavity of the oven.

21. A retractable oven rack, comprising:

a wire base that is slidably mountable on protruding shelf members located on two opposite inner walls of an oven cavity, the wire base including first and second wire sections that are parallel to one another and that extend across the front and rear of the wire base and third and fourth wire sections that are parallel to one another and that extend along opposite sides of the wire base, wherein upwardly angled portions are formed adjacent ends of the third and fourth wire sections, the upwardly angled portions being configured to engage stops on the protruding shelf members on the inner walls of an oven cavity to limit the amount that the wire base can be slid out of and into the oven cavity, the wire base further comprising first and second wire support rods that extend parallel to and above the third and fourth wire sections on opposite sides of the wire base; and a grid shelf comprising:

a wire grid, first and second grid stops that project from opposite sides of the rear of the grid shelf, and first and second supports that extend parallel to opposite side edges of the wire grid and above the wire grid, wherein the first and second supports rest on and are slidably supported by the first and second wire support rods such that the grid shelf can be slid forwards and backwards along the wire base, wherein a grid shelf stop member is formed on a bottom of each of the first and second wire support rods of the wire base, and wherein the grid shelf stop members block forward movement of the first and second grid stops of the grid shelf to limit the amount that the grid shelf can be slid forward on the wire base.

* * * * *